US007111330B1

(12) United States Patent
Korf

(10) Patent No.: US 7,111,330 B1
(45) Date of Patent: Sep. 26, 2006

(54) AUTOMATIC ADDITIVE DISPENSING ASSEMBLY

(76) Inventor: Rabbi Abraham Korf, 1257 Alton Rd., Miami Beach, FL (US) 33139

( * ) Notice: Subject to any disclaimer, the term of this patent is extended or adjusted under 35 U.S.C. 154(b) by 0 days.

(21) Appl. No.: 11/060,958

(22) Filed: Feb. 18, 2005

(51) Int. Cl.
*E03D 9/02* (2006.01)

(52) U.S. Cl. ..... 4/226.1

(58) Field of Classification Search ..... 4/222, 4/226.1, 227.1, 227.6, 225.1
See application file for complete search history.

(56) References Cited

U.S. PATENT DOCUMENTS

| | | | | |
|---|---|---|---|---|
| 270,111 | A | 1/1883 | Pike | |
| 306,092 | A | 10/1884 | McGann | |
| 317,634 | A | 5/1885 | Ernst | |
| 331,693 | A | 12/1885 | Ernst | |
| 521,411 | A * | 6/1894 | Johnson | 4/226.1 |
| 598,103 | A | 2/1898 | La Fave | |
| 1,211,137 | A | 1/1917 | Grant | |
| 2,682,059 | A | 6/1954 | Grossman | |
| 3,001,210 | A | 9/1961 | Diehl | |
| 3,060,456 | A | 10/1962 | Jacobs | |
| 3,118,462 | A | 1/1964 | Pannutti | |
| 3,591,873 | A | 7/1971 | Cheng | |
| 3,623,167 | A | 11/1971 | Syrenne et al. | |
| 4,841,578 | A | 6/1989 | Mercer | |
| 5,778,459 | A * | 7/1998 | Guerin | 4/225.1 |

FOREIGN PATENT DOCUMENTS

| | | |
|---|---|---|
| GB | 4207 | 0/1897 |
| GB | 359604 | 10/1931 |
| JP | 06228996 A * | 8/1994 |

* cited by examiner

*Primary Examiner*—Tuan Nguyen
(74) *Attorney, Agent, or Firm*—Malloy & Malloy, P.A.

(57) ABSTRACT

A dispensing assembly structured to automatically add or dispense cleanser, deodorant, disinfectant and/or like additive to a toilet bowl or urinal, particularly of the type used in commercial applications which are normally connected to a pressurized water supply for flushing without the presence of an accessible flush tank, as is present in most domestic toilet fixtures. The assembly comprising a retention chamber disposed in fluid communication between a pressurized water supply pipe and the toilet bowl or urinal and structured to retain the additive in contact with at least a first portion of the flush water. The outlet of the pressurized water supply pipe is structured to discharge a second portion of the flush water into the retention chamber thereby displacing the first portion of the flush water from the retention chamber into the toilet bowl or urinal and providing the additional water necessary during a flushing operation.

19 Claims, 3 Drawing Sheets

AUTOMATIC ADDITIVE DISPENSING ASSEMBLY

BACKGROUND OF THE INVENTION

1. Field of the Invention

This invention relates to an automatic additive dispensing assembly structured for use with a toilet fixture which is normally connected to a pressurized water supply for flushing without the presence of an accessible flush tank, such as, by way of example, a commercial toilet bowl or urinal. The assembly is structured to permit cleanser, deodorant, disinfectant and/or like additives to be automatically dispensed into the toilet bowl or urinal with the flush water concurrently to a flushing operation, and activated thereby. The additive may be provided in solid or liquid form, as are commercially available, such that the additive is effectively mixed into at least a first portion of the flush water, prior to the flushing operation.

2. Description of the Prior Art

In most modern-day commercial toilet fixtures, such as a sit-down toilet or a stand-up urinal, the flush water is provided directly from a supply pipe connected to a pressurized water supply, wherein a flushing handle is usually accessible exteriorly of an in-wall connection to the pressurized water supply so that the user of the toilet fixture can manipulate the handle or activate an electronic eye to open a flush valve thereby serving to discharge the flush water to the toilet bowl or urinal in a flushing operation. Such commercial toilet fixtures differ from domestic structures wherein a flush tank is normally provided in fluid communication between the water supply and the interior of the toilet bowl. Manipulation of the flushing handle in such devices allows water to flow from the flush tank, under gravity, into the toilet bowl causing a flushing action.

In both commercial and domestic applications it is well known that a cleanser, deodorant and/or disinfectant mixed into the flush water discharged to the toilet bowl or urinal, is beneficial in terms of eliminating unwanted odors as well as keeping the interior surface of the toilet bowl or urinal clean of any algae or like substance forming thereon. In the area of domestic toilets, wherein the aforementioned flush tank is frequently accessible, it is common practice for the placement of a dissolvable solid or liquid cleanser, deodorant and/or disinfectant to be placed directly into the flush tank to permit mixing into the flush water retained therein. Accordingly, upon flushing, the water within the flush tank having the additive entrained therein will pass into the toilet bowl serving to cleanse, deodorize and/or disinfect the interior thereof. Replacement of such additive is easily accomplished by lifting the top of the flush tank and adding a new supply of additive directly thereto.

In most commercial toilet and urinal fixtures, however, there is no mechanism to place an additive such that it may be retained to mix into any portion of the flush water prior to a flushing operation.

It is, thus, recognized as being more difficult to provide cleanser, deodorant, disinfectant and/or like additive to the flush water of a toilet fixture without a flush tank since the supply pipe which discharges water to the interior of the toilet bowl or urinal is connected directly to a pressurized water supply structured to force flush water directly into the toilet bowl or urinal. The supplying of a preferred additive to such an assembly therefore presently requires expensive modification of the plumbing and/or a replacement of the connection of such plumbing to the pressurized water supply system.

Several United States patents disclose systems and/or apparatus for the provision of the aforementioned type of additive to a commercial type toilet fixture which is absent any readily accessible flush tank, as is common with domestic toilet fixtures. However, none of these patents provide for sufficient retention time of an additive with at least a portion of the flush water to assure that an effective concentration of the additive is mixed into any portion of the flush water prior to discharge into the toilet bowl or urinal during a flush operation. Accordingly, there is a recognized need in this area for a system and/or apparatus for automatically providing an additive to the flush water of a commercial type toilet bowl or urinal such that the additive is mixed into at least a portion of the flush water prior to the flushing operation.

The present invention provides an assembly wherein mixing of a cleanser, deodorant and/or disinfectant with at least a portion of the flush water is accomplished prior to flushing, for a toilet fixture not having a flush tank. Specifically, the present invention comprises a retention chamber at least temporarily containing a first portion of the flush water in which an effective concentration of at least one additive is mixed therein, and a second portion of the flush water obtained from a conventional pressurized water supply which displaces the first, concentrated portion of the flush water from the retention chamber and provides the additional flush water necessary during the flushing operation, which also flows into and out of the retention chamber. More in particular, between successive flushing operations, sufficient retention time is provided for at least a first portion of the flush water to contact an additive such that an effective concentration of the additive is mixed into the first portion of flush water prior to discharge into the toilet bowl or urinal.

In the past, commercial toilet fixtures have used screens or a solid charge of an additive in a disk-like shape, for example, one placed in a urinal. However, the effectiveness of such charges is limited due to the lack of contact time with the flush water such as is required to assure an effective concentration of the additive in the flush water. To overcome the disadvantages of prior devices, expensive assemblies have been suggested, as in the aforementioned U.S. patents, however, such expensive assemblies comprise numerous components which operate as a machine and, as such, require relatively high initial and maintenance costs. The structure of the invention disclosed herein avoids the prior art problems and is well suited for the purposes specified and apparent from the following description. In particular, this invention exposes at least a portion of the flush water to the additive selected, which may include any chemical additive for the intended cleansing, deodorizing and/or disinfecting purpose that is on the market, for a period of time sufficient to permit an effective concentration of the additive to be mixed therein. In addition, the invention disclosed herein does not require expensive installation, as it is structured for simple, easy, do-it-yourself installation, comprising connections which may be readily adjusted to a required length, and which requires little to no maintenance or repair.

SUMMARY OF THE INVENTION

The present invention is directed towards an automatic additive dispensing assembly for use with a toilet fixture which does not have an accessible flush tank, such as a commercial type toilet bowl or urinal, wherein a cleanser, deodorant, disinfectant and/or like additive is retained within at least a portion of the flush water prior to at least that portion of flush water passing into the toilet bowl or urinal, along with an additional amount of flush water necessary for a flushing operation. As such, the entire volume of the flush water that passes into the toilet bowl or urinal will be affected by the additive, and will impart the desired cleansing, deodorizing, disinfecting and/or other desired effect.

The additive, either in the form of a cleanser, deodorant, disinfectant, etc., is disposed in a retention chamber, the additive comprising any of a variety of conventional solid or liquid forms. The structure of the retention chamber is such as to readily receive the additive, such as a water dissolvable solid or liquid material. A portion of the flush water is retained within the retention chamber for a period of time at least equal to the time between flushing operations, thus providing sufficient retention time for the additive to be mixed into the first portion of the flush water. Subsequently, activation of the flush handle or like activating means will cause a second portion of the flush water to pass from the conventional pressurized water supply through a supply pipe and into the retention chamber, thereby displacing the now concentrated first portion of the flush water retained therein, as well as providing an additional amount of flush water as is required for a flushing operation. Specifically, this will cause an overflow of the concentrated first portion of the flush water from within the retention chamber, as the supply pipe for the second portion of the flush water is structured to discharge into and displace the first portion of the flush water from the retention chamber, as well as an amount of the second portion of the flush water which also flows into and out of the retention chamber during a flushing operation. The supply pipe outlet is preferably positioned in the retention chamber thereby displacing the concentrated first portion of the flush water additive which overflows into an outer container and directly therefrom into the toilet bowl or urinal for cleansing, deodorizing, disinfecting, etc.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

As shown in the figures, the present invention is directed towards an automatic additive dispensing assembly, generally indicated as 10, structured to disperse an additive such as a cleanser, deodorant, disinfectant, etc., into at least a portion of the flush water prior to discharge into a toilet bowl 12 or urinal 12'.

Figure 1:
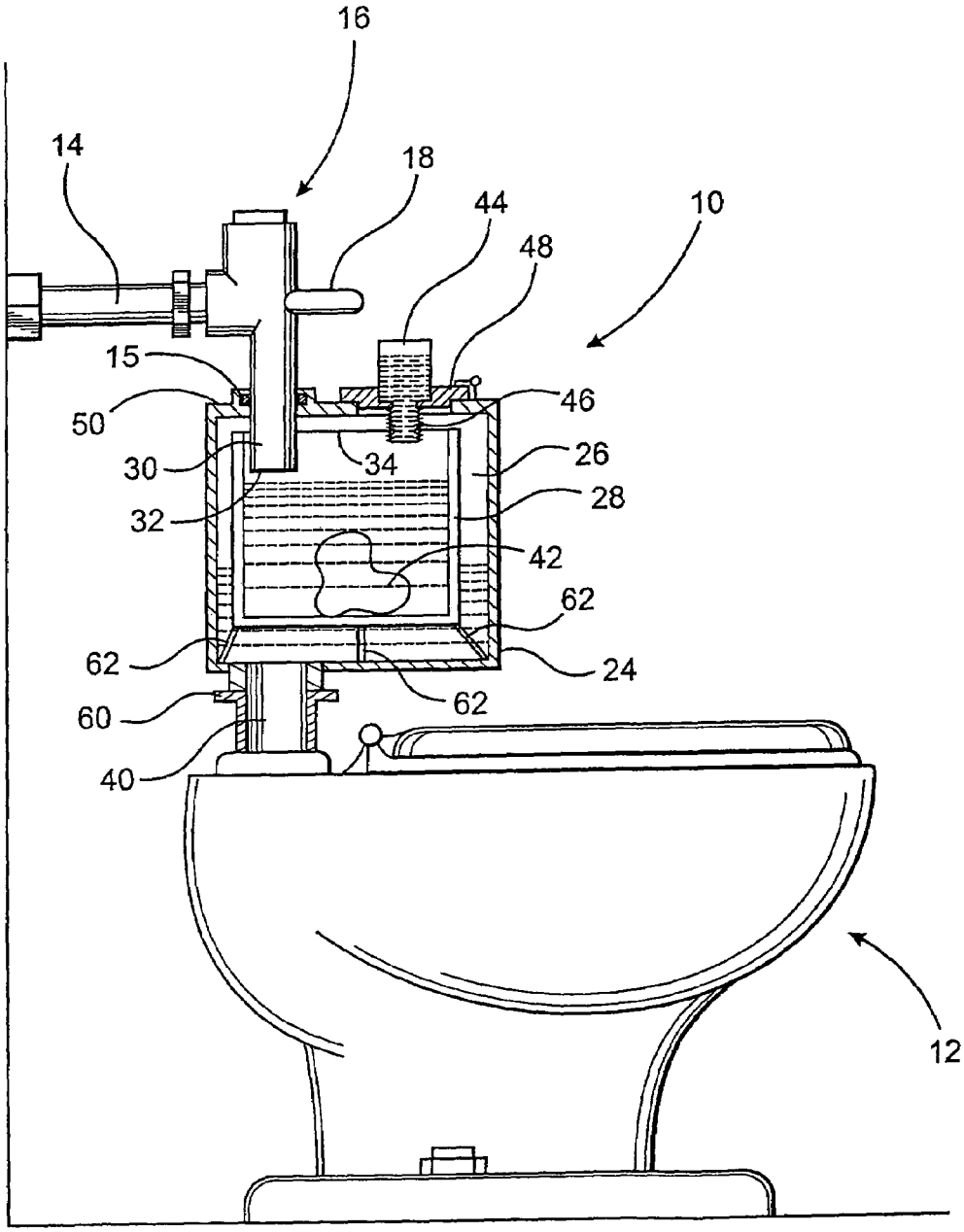
FIG. 1 is a side view in partial section illustrating one embodiment of an automatic additive dispensing assembly of the present invention.
Figure 3:
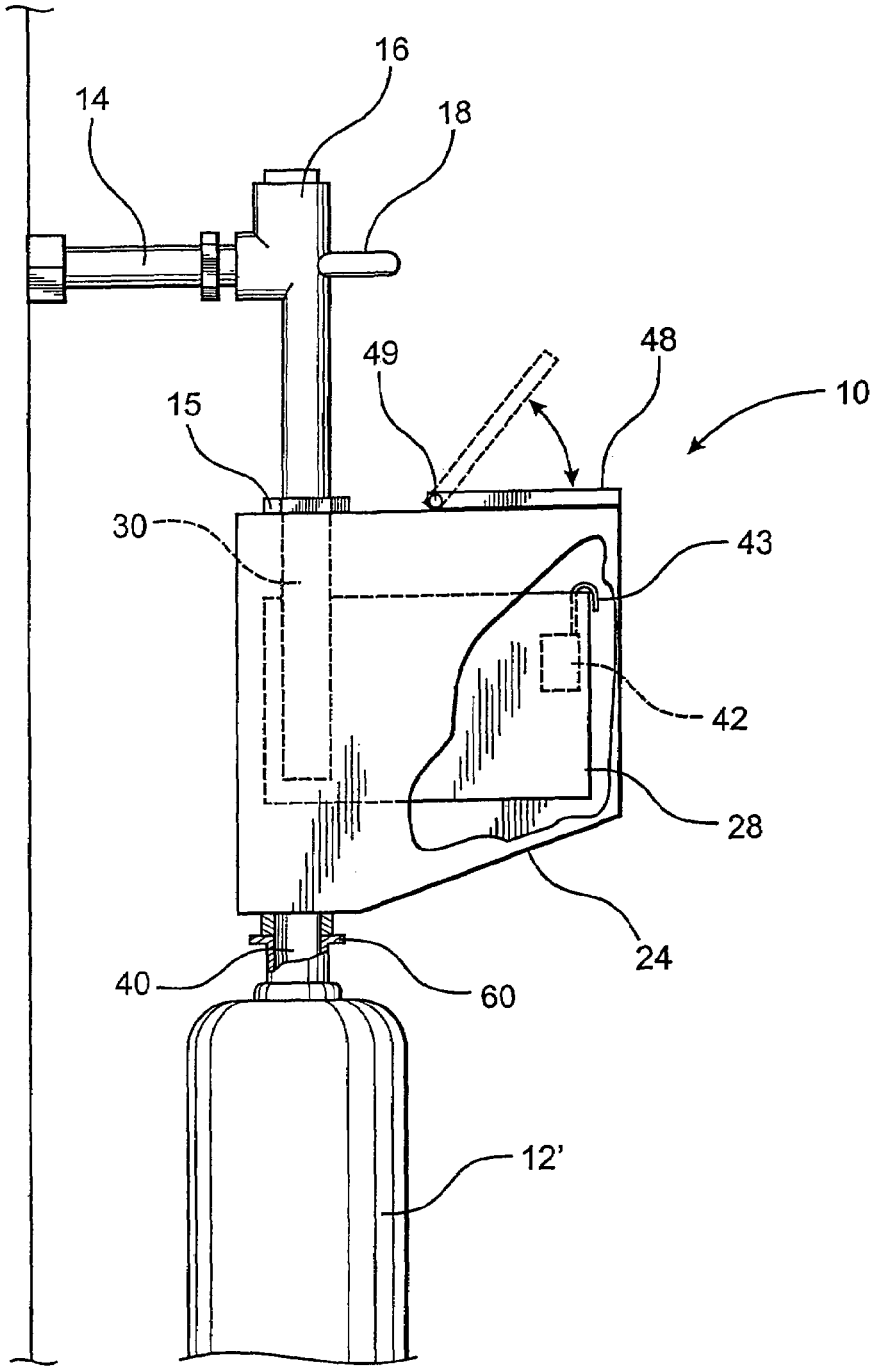
FIG. 3 is a side view in partial section of one preferred embodiment of the assembly of the present invention.

In a toilet fixture of the type represented in FIGS. 1 and 3, wherein a flush tank is not present, water flows directly from a conventional pressurized water supply into the toilet 12 or urinal 12' via a connecting conduit 14 through which water flow is regulated by a flush valve 16. The flush valve 16 may be activated by a handle or lever 18, or it may be automatically activated, such as by an electronic eye or other motion type sensor. As will be appreciated, when the flush valve 16 is activated to open in a standard commercial toilet fixture, the entire volume of the flush water passes directly from the conventional pressurized water supply into the toilet bowl 12 or urinal 12' for the flushing of waste products therefrom.

The assembly 10 of the present invention comprises an outer container 24 having a hollow interior 26 of sufficient dimension and configuration to enclose a retention chamber 28 therein, the retention chamber 28 structured to retain at least a first portion of the flush water. The retention chamber 28 structured to be disposed in fluid communication with a supply pipe 30 which discharges a second portion of the flush water from the connecting conduit 14 into the retention chamber 28, upon activation of the flush valve 16. More in particular, the retention chamber 28 is structured to be disposed in fluid communication with an outlet 32 of the supply pipe 30, the supply pipe 30 passing through an aperture in the outer container 24, and engaging a support bushing 15 structured to interconnect the supply pipe 30 thereto. The upper end of the retention chamber 28 has an open mouth configuration 34 which defines the outlet of the retention chamber 28. The open mouth 34, as well as substantially the entire retention chamber 28 is, of course, positioned and enclosed within the outer container 24. Therefore, as the second portion of the flush water is discharged into the retention chamber 28 from the supply pipe 30, the first portion of the flush water being displaced and overflowing over the periphery of the open mouth 34 and into the interior 26 of the outer container 24, along with an amount of the second portion of flush water as is required during a flushing operation. The interior 26 of the outer container 24 is structured to be disposed in direct fluid communication with the discharge pipe 40, which is disposed in fluid communication with the interior of the toilet bowl 12 or urinal 12' thereby permitting discharge of the entire volume of the flush water from the outer container 24 to the toilet bowl 12 or urinal 12' during a normal flushing operation.

In operation, a pre-selected additive 42 such as cleanser, deodorant, disinfectant and/or the like is disposed in a contacting relationship with at least the first portion of flush water retained within retention chamber 28, such that the additive 42 can mix into the first portion of flush water. Such additive 42 may be in the form of a solid which disperses in water or, alternatively, in the form of a liquid initially maintained in a supply container 44. When the supply container 44 is utilized, a mounting means in the form of an internally threaded aperture as at 46, disposed in cover 48, may be used to removably secure the supply container 44 over the open mouth 34 of the retention chamber 28 thereby allowing the liquid additive to pass therein. The solid additive 42 is illustrated as free floating in the contacting relationship with the first portion of flush water in the retention chamber 28 in FIG. 1, however, it is understood to be within the scope of the present invention to utilize a supporting hook or brace 43 to support the additive 42 in the contacting relationship with the first portion of flush water in the retention chamber 28.

In either embodiment, a second portion of the flush water is discharged directly into the retention chamber 28 through the outlet 32 of the supply pipe 30, upon activation of the flush valve 16. During normal operation, the retention chamber 28 is already filled with a first portion of the flush water in which the additive 42 has been retained for sufficient time, being at least the time between flushing operations, to permit an effective concentration of the additive 42 to mix into at least the first portion of the flush water. As used herein, the phrase "effective concentration" shall mean that concentration of the additive 42 in the flush water required for the additive 42 to impart an intended cleansing, deodorizing, disinfecting and/or other desired effect to the toilet bowl 12 or urinal 12' during the flushing operation.

As such, and as previously indicated, the discharge of the second portion of the flush water into the retention chamber 28 will cause an overflow of the first portion of the flush water, which comprises the effective concentration of the additive 42, into the outer container 24 along with an amount of the second portion of flush water as is required during a flushing operation. Such overflow will pass over the open mouth 34 of the retention chamber 28 and into the interior 26 of the outer container 24, and therefrom will discharge into the interior of the toilet bowl 12 or urinal via the discharge pipe 40.

After a flushing operation, a volume of the second portion of the flush water is retained within the retention chamber 28 for at least the period of time between flushing operations, thereby becoming the first portion of the flush water for the subsequent flushing operation. During this time, as noted above, the additive 42 will have sufficient time to mix into the first portion of the flush water in the retention chamber 28, such that the first portion of the flush water once again comprises an effective concentration of the additive 42 prior to the subsequent flushing operation.

The assembly 10 of the present invention may include a brace or support member 62 positioned in the interior 26 of the outer container 24, the brace 62 being structured and disposed to support the retention chamber 28 relative to the base of the outer container 24, as shown in FIG. 1.

Figure 2:
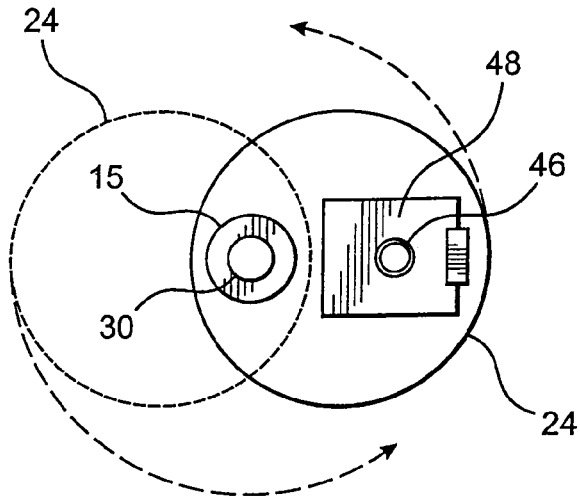
FIG. 2 is a top view in partial phantom showing the selective repositioning of one embodiment of the assembly.

A further feature of at least one embodiment of the present invention is the selective positioning of the entire assembly 10 between the position shown in FIG. 1 and in solid lines in FIG. 2, and the position shown in phantom lines in FIG. 2. More specifically, the assembly 10, including the outer container 24, may be disposed into the position shown in solid lines in FIG. 2 for refilling, repair, replacement, etc. However, when the toilet bowl 12 or urinal 12' is intended to be used, the assembly 10, or more specifically, the outer container 24, may be rotated about a support flange 60, the support flange 60 being structured to engage the discharge pipe 40 in an interconnected and supporting relation. The outer container 24 may also be rotated relative to the supply pipe 30, and more particularly, a longitudinal axis thereof. More specifically, the outer container 24 may be selectively rotated or positioned relative to the toilet bowl 12 or urinal 12' and the supply pipe 30, in a supported relation about the support flange 60, between an access position as represented in solid lines in FIGS. 1 and 2, or a stored position as represented in phantom lines in FIG. 2. Further, the stored position may be to either opposite side of the toilet bowl 12 or urinal 12' and supply pipe 30, rather than to the rear thereof as shown in phantom lines in FIG. 2.

One further preferred embodiment of the automatic additive dispensing assembly 10 of the present invention is illustrated in FIG. 3. As may be seen from FIGS. 1 through 3, the outer container 24 comprises a cover 48 structured to facilitate ease of access to the retention chamber 28 for replenishment of additive 42, without requiring rotation of the assembly 10, and in particular, the outer container 24, into and out of position, as illustrated in the embodiment of FIG. 2. The cover 48 may be connected to the outer container 24, such as by a hinge mechanism 49, the hinge mechanism 49 structured to facilitate access to the retention chamber 28. More in particular, the cover 48 is movably secured to the outer container 24 and selectively positionable in the direction indicated by the arrow between a closed position and an open position (shown in phantom lines), the open position providing access to the retention chamber 28 to permit replenishment of the additive 42.

Figure 4:
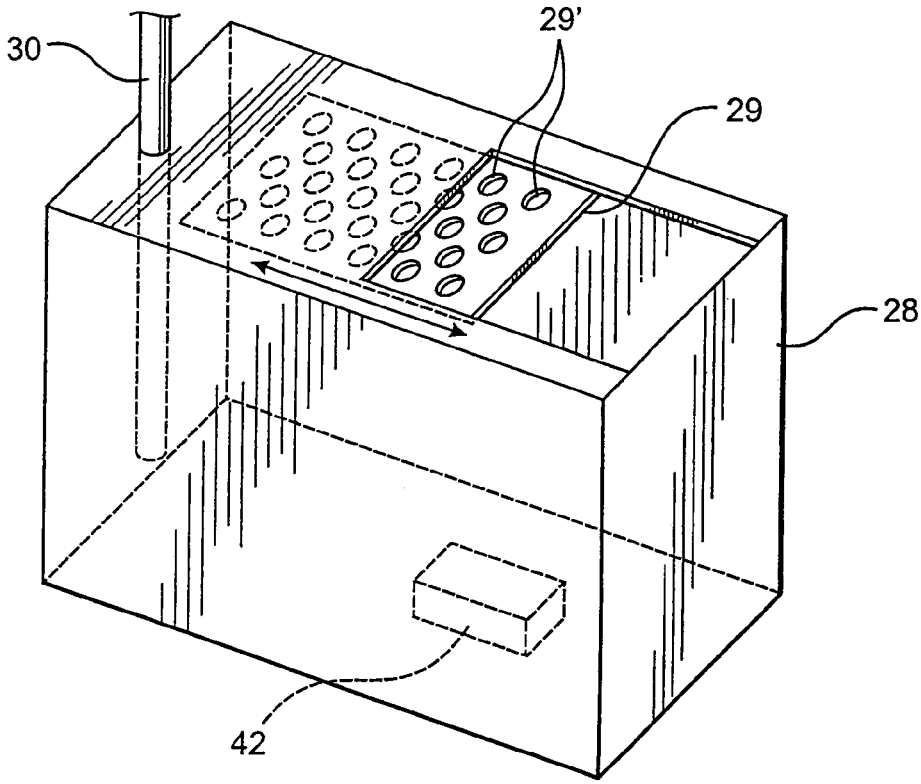
FIG. 4 is a partial perspective view of one preferred embodiment of a retention chamber of the present invention comprising a lid.

In addition, in at least one embodiment the retention chamber 28 comprises a lid 29 disposed in an overlying relationship thereto, as illustrated in FIG. 4. More in particular, the lid 29 is disposed in an overlying relation to the open mouth 34 of the retention chamber 28 and is structured to retain the additive 42 therein during a flushing operation. As such, and as is also illustrated in FIG. 4, the lid 29 necessarily comprises a plurality of apertures 29, structured to permit the entire volume of flush water to overflow from the retention chamber 28 therethrough into the outer container 24, during a flushing operation. At the same time, the lid 29 is structured to substantially prevent the additive 42 from being displaced from within the retention chamber 28 by the flush water during the flushing operation.

The lid 29 of the retention chamber 28 is further structured to be disposable between an open orientation and a closed orientation, as further illustrated in FIG. 4. The open orientation of the lid 29 structured to facilitate the addition and/or replacement of the additive 42 within the retention chamber 28. In at least one embodiment, the lid 29 is slidably positionable between the open orientation and the closed orientation.

To facilitate quick and easy installation of the automatic additive dispensing assembly 10 of the present invention, in one preferred embodiment, the support bushing 15 or the support flange 60 or both are adjustable to accommodate installation of the assembly 10 to an existing commercial toilet fixture. More specifically, the support bushing 15 and/or the support flange 60 comprise an adjustable extension to accommodate varied distances between the outlet 32 of the supply pipe 30 and the inlet to the discharge pipe 40. Additionally, in one preferred embodiment, both the support bushing 15 and the support flange 60 comprise an adjustable seat mechanism structured to permit quick, easy, and secure interconnection of the supply pipe 30 and discharge pipe 40 in fluid communication with the assembly 10 of the present invention, the adjustable seat mechanisms structured to accommodate various diameters of the pipes. Further, in at least one embodiment, the support bushing 15 and/or the support flange 60 may comprise an adjustable length to accommodate installation of the automatic additive dispensing assembly 10 into a variety of existing plumbing arrangements.

Now that the invention has been described,

What is claimed is:

1. An automatic additive dispensing assembly structured for use with a toilet fixture which is directly connected to a pressurized water supply without a flush tank, said assembly comprising:

an outer container having a hollow interior, a supply pipe from the pressurized water supply structured to engage said outer container in an interconnected and fluid communicating relation, the supply pipe comprising a longitudinal axis, a support bushing structured to movably interconnect the supply pipe to said outer container in said fluid communicating relation, a retention chamber comprising an open upper mouth positioned within said hollow interior of said outer container, said retention chamber disposed in fluid communication with the supply pipe, a first portion of flush water retained in said retention chamber for a period of time, an additive retained in said retention chamber in a contacting relationship with said first portion of flush water for said period of time, a discharge pipe structured to engage said hollow interior of said outer container in an interconnected and fluid communicating relation, the discharge pipe further disposed in fluid communication with an interior of the toilet fixture, a support flange structured to engage the discharge pipe in an interconnected and supporting relation, said support bushing and said support flange cooperatively structured to permit rotation of said outer container simultaneously about the supply pipe and the discharge pipe along the longitudinal axis of the supply pipe while disposed in said interconnected and fluid communicating relation with each, the supply pipe structured to discharge a second portion of flush water into said retention chamber, said second portion of flush water thereby displacing at least said first portion of flush water, said open upper mouth structured to permit at least said first portion of flush water to overflow thereover into said hollow interior of said outer container, and said hollow interior structured to facilitate discharge of at least said first portion of flush water into the interior of the toilet fixture via the discharge pipe.

2. The assembly as recited in claim 1 wherein said period of time is at least partially defined as at least a time between consecutive flushing operations.

3. The assembly as recited in claim 2 wherein said period of time is further defined as an amount of time required for said additive to mix into said first portion of flush water such that said first portion of flush water comprises an effective concentration of said additive.

4. The assembly as recited in claim 1 wherein said outer container and said retention chamber are cooperatively structured and disposed to facilitate transfer of at least said first portion of flush water from said retention chamber to said hollow interior of said outer container upon discharge of said second portion of flush water into said retention chamber.

5. The assembly as in claim 1 further comprising a cover movably secured to said outer container by a hinge mechanism and selectively positionable between a closed and an open position, said open position providing access to at least an interior of said retention chamber to facilitate replenishment of said additive.

6. The assembly as in claim 1 wherein the supply pipe comprises an elongated configuration of a sufficient length to extend into at least a portion of said retention chamber.

7. The assembly as recited in claim 1 wherein said retention chamber further comprises a lid disposed in an overlying relation to said open mouth, said lid disposable between an open orientation and a closed orientation, at least a portion of said lid comprising a plurality of apertures to permit at least said first portion of flush water to overflow from said retention chamber therethrough while said lid is disposed in said closed orientation.

8. The assembly as in claim 1 wherein said outer container is movably mounted relative to the toilet fixture and selectively disposable between an access position and a stored position.

9. An automatic additive dispensing assembly structured for use with a urinal, said assembly comprising:

an outer container having a hollow interior, a supply pipe from a pressurized water supply structured to engage said outer container in an interconnected and fluid communicating relation, the supply pipe comprising a longitudinal axis, a support bushing structured to movably interconnect the supply pipe to said outer container in said fluid communicating relation, a retention chamber positioned within said hollow interior of said outer container, said retention chamber structured to be disposed in fluid communication with the supply pipe, a first portion of flush water being retained in said retention chamber for a period of time, an additive retained in said retention chamber in a contacting relationship with said first portion of flush water for said period of time, said period of time at least partially defined as an amount of time required for said additive to mix into said first portion of flush water such that said first portion of flush water comprises an effective concentration of said additive, said effective concentration being at least partially defined as a concentration of said additive in said first portion of flush water required for said additive to impart an intended effect to the urinal during the flushing operation, a discharge pipe structured to engage said hollow interior of said outer container in an interconnected and fluid communicating relation, the discharge pipe disposed in fluid communication with an interior of the urinal, a support flange structured to engage the discharge pipe in an interconnected and supporting relation, said support bushing and said support flange cooperatively structured to permit rotation of said outer container simultaneously about the supply pipe and the discharge pipe along the longitudinal axis of the supply pipe while disposed in said interconnected and fluid communicating relation with each, the supply pipe structured to discharge a second portion of flush water into said retention chamber, said second portion of flush water thereby displacing at least said first portion of flush water into said hollow interior of said outer container, said hollow interior structured to facilitate discharge of at least said first portion of flush water into the interior of the urinal via the discharge pipe, and said outer container movably mounted relative to the urinal and selectively disposable between an access position and a stored position.

10. The assembly as recited in claim 9 wherein said outer container and said retention chamber are cooperatively structured and disposed to facilitate transfer of at least said first portion of flush water from said retention chamber to said hollow interior of said outer container upon discharge of said second portion of flush water into said retention chamber.

11. The assembly as in claim 9 further comprising a cover movably secured to said outer container by a hinge mechanism and selectively positionable between a closed and an open position, said open position providing access to at least an interior of said retention chamber to facilitate replenishment of said additive.

12. The assembly as in claim 9 wherein the supply pipe comprises an elongated configuration of a sufficient length to extend into at least a portion of said retention chamber.

13. The assembly as in claim 9 wherein said retention chamber further comprises an open upper mouth, said outer container disposed in surrounding relation to said open upper mouth of said retention chamber and in receiving relation to at least said first portion of flush water overflowing thereover.

14. The assembly as in claim 9 wherein said outer container is rotatably mounted about an axis of the supply pipe and selectively positionable between said access position and said stored position.

15. An automatic additive dispensing assembly structured for use with a toilet fixture which is directly connected to a pressurized water supply without a flush tank, said assembly comprising:

an outer container having a hollow interior, a supply pipe from the pressurized water supply structured to engage said outer container in an interconnected and fluid communicating relation, the supply pipe comprising a longitudinal axis, a support bushing structured to movably interconnect the supply pipe to said outer container in said fluid communicating relation, a retention chamber positioned within said hollow interior of said outer container, said retention chamber structured to be disposed in fluid communication with the supply pipe, a first portion of flush water being retained in said retention chamber for a period of time, an additive retained in said retention chamber in a contacting relationship with said first portion of flush water for said period of time, said period of time at least partially defined as an amount of time required for said additive to mix into said first portion of flush water such that said first portion of flush water comprises an effective concentration of said additive, said effective concentration being at least partially defined as a concentration of said additive in said first portion of flush water required for said additive to impart an intended effect to the toilet fixture during the flushing operation, a discharge pipe structured to engage said hollow interior of said outer container in an interconnected and fluid communicating relation, the discharge pipe disposed in fluid communication with an interior of the toilet fixture, a support flange structured to engage the discharge pipe in an interconnected and supporting relation, said support bushing and said support flange cooperatively structured to permit rotation of said outer container simultaneously about the supply pipe and the discharge pipe along the longitudinal axis of the supply pipe while disposed in said interconnected and fluid communicating relation with each, the supply pipe structured to discharge a second portion of flush water into said retention chamber, said second portion of flush water thereby displacing at least said first portion of flush water into said hollow interior of said outer container, said hollow interior structured to facilitate discharge of at least said first portion of flush water into the interior of the toilet fixture via the discharge pipe, and a cover movably secured to said outer container and selectively positionable between a closed and an open position, said open position providing access to at least an interior of said retention chamber to facilitate replenishment of said additive.

16. The assembly as recited in claim 15 wherein said outer container and said retention chamber are cooperatively structured and disposed to facilitate transfer of at least said first portion of flush water from said retention chamber to said hollow interior of said outer container upon discharge of said second portion of flush water into said retention chamber.

17. The assembly as in claim 15 wherein said outer container is movably mounted relative to the toilet fixture and selectively disposable between an access position and a stored position.

18. The assembly as in claim 17 wherein said outer container is rotatably mounted about an axis of the supply pipe and selectively positionable between said access position and said stored position.

19. An automatic additive dispensing assembly structured for use with a urinal, said assembly comprising:

an outer container having a hollow interior, a supply pipe from a pressurized water supply structured to engage said outer container in an interconnected and fluid communicating relation, the supply pipe comprising a longitudinal axis, a support bushing structured to movably interconnect the supply pipe to said outer container in said fluid communicating relation, a retention chamber comprising an open upper mouth positioned within said hollow interior of said outer container, said retention chamber disposed in fluid communication with the supply pipe, a first portion of flush water being retained in said retention chamber for a period of time, an additive retained in said retention chamber in a contacting relationship with said first portion of flush water for said period of time, said period of time at least partially defined as an amount of time required for said additive to mix into said first portion of flush water such that said first portion of flush water comprises an effective concentration of said additive, said effective concentration being at least partially defined as a concentration of said additive in said first portion of flush water required for said additive to impart an intended effect to the urinal during the flushing operation, a discharge pipe structured to engage said hollow interior of said outer container in an interconnected and fluid communicating relation, the discharge pipe disposed in fluid communication with an interior of the urinal, a support flange structured to engage the discharge pipe in an interconnected and supporting relation, said support bushing and said support flange cooperatively structured to permit rotation of said outer container simultaneously about the supply pipe and the discharge pipe along the longitudinal axis of the supply pipe while disposed in said interconnected and fluid communicating relation with each, the supply pipe structured to discharge a second portion of flush water into said retention chamber, said second portion of flush water thereby displacing at least said first portion of flush water and said open upper mouth structured to permit at least said first portion of flush water to overflow thereover into said hollow interior of said outer container, said hollow interior structured to facilitate discharge of at least said first portion of flush water into the interior of the urinal via the discharge pipe, said outer container rotatably mounted about an axis of the supply pipe and selectively positionable between an access position and a stored position, and a cover movably secured to said outer container and selectively positionable between a closed position and an open position, said open position providing access to at least an interior of said retention chamber to facilitate replenishment of said additive.

* * * * *